US012151723B2

(12) United States Patent
Widlroither et al.

(10) Patent No.: US 12,151,723 B2
(45) Date of Patent: Nov. 26, 2024

(54) MONITORING DEVICE FOR MONITORING A TEMPORARY RAIL CONNECTION OF TWO RAIL PORTIONS OF A RAIL AND RAIL CONNECTION SYSTEM HAVING SUCH A MONITORING DEVICE

(71) Applicant: ROBEL Bahnbaumaschinen GmbH, Freilassing (DE)

(72) Inventors: Otto Widlroither, Freilassing (DE); Tim Stafford, London (GB); Michael Seeleithner, Anthering (AT)

(73) Assignee: ROBEL Bahnbaumaschinen GmbH, Freilassing (DE)

( * ) Notice: Subject to any disclaimer, the term of this patent is extended or adjusted under 35 U.S.C. 154(b) by 919 days.

(21) Appl. No.: 17/278,677

(22) PCT Filed: Sep. 5, 2019

(86) PCT No.: PCT/EP2019/073647
§ 371 (c)(1),
(2) Date: Mar. 23, 2021

(87) PCT Pub. No.: WO2020/064289
PCT Pub. Date: Apr. 2, 2020

(65) Prior Publication Data

US 2022/0032974 A1 Feb. 3, 2022

(30) Foreign Application Priority Data

Sep. 24, 2018 (DE) ..... 202018105484.8

(51) Int. Cl.
*B61K 9/08* (2006.01)
*E01B 11/02* (2006.01)
(Continued)

(52) U.S. Cl.
CPC ..... *B61K 9/08* (2013.01); *E01B 11/02* (2013.01); *E01B 11/12* (2013.01); *E01B 11/18* (2013.01);
(Continued)

(58) Field of Classification Search
CPC .. B61K 9/08; B61K 9/10; E01B 11/18; E01B 11/20; E01B 11/02; E01B 11/22;
(Continued)

(56) References Cited

U.S. PATENT DOCUMENTS 7,228,747 B2 6/2007 Pieper
10,525,995 B2 1/2020 Widlroither

FOREIGN PATENT DOCUMENTS

AU 2004293547 A1 * 7/2006 ..... E01B 11/18
CN 106004928 A * 10/2016
(Continued)

*Primary Examiner* — Zachary L Kuhfuss
*Assistant Examiner* — James William Jones
(74) *Attorney, Agent, or Firm* — Laurence A. Greenberg; Werner H. Stemer; Ralph E. Locher

(57) ABSTRACT

A monitoring device for monitoring a temporary rail connection of two rail portions includes a first fixing element which can be fixed to the first rail portion, and a second fixing element which can be fixed to the second rail portion. The monitoring device furthermore includes a first distance sensor for measuring a first distance between the fixing elements, and a second distance sensor for measuring a second distance between the first fixing element and a first clamping device of the temporary rail connection. The monitoring device allows reliable monitoring of the temporary rail connection. A rail connection system for creating and monitoring a temporary rail connection of two rail portions of a rail is also provided.

11 Claims, 4 Drawing Sheets

(51) Int. Cl.

| | |
|---|---|
| ***E01B 11/12*** | (2006.01) |
| ***E01B 11/18*** | (2006.01) |
| ***E01B 11/20*** | (2006.01) |
| ***E01B 11/22*** | (2006.01) |
| ***E01B 11/36*** | (2006.01) |
| *B61K 9/10* | (2006.01) |
| *B61L 1/20* | (2006.01) |
| *B61L 27/53* | (2022.01) |

(52) U.S. Cl.
CPC ..... *E01B 11/20* (2013.01); *E01B 11/22* (2013.01); *E01B 11/36* (2013.01); *B61K 9/10* (2013.01); *B61L 1/20* (2013.01); *B61L 27/53* (2022.01)

(58) Field of Classification Search
CPC ..... E01B 11/24; E01B 11/26; E01B 11/36; E01B 11/38; E01B 11/16; E01B 11/10; E01B 11/12; B61L 27/53; B61L 1/20
USPC ..... 238/1
See application file for complete search history.

(56) References Cited

FOREIGN PATENT DOCUMENTS

| | | | | | |
|---|---|---|---|---|---|
| CN | 106414212 | A | * | 2/2017 | ..... B61K 9/08 |
| DE | 202015005277 | U1 | | 10/2015 | |
| DE | 202017103074 | U1 | * | 7/2017 | ..... B61L 1/20 |
| EP | 1697592 | B1 | | 4/2007 | |
| EP | 3253921 | B1 | * | 5/2019 | ..... B01L 1/02 |
| WO | WO-03037695 | A1 | * | 5/2003 | ..... B61L 1/06 |
| WO | 2018215361 | A1 | | 11/2018 | |

* cited by examiner

MONITORING DEVICE FOR MONITORING A TEMPORARY RAIL CONNECTION OF TWO RAIL PORTIONS OF A RAIL AND RAIL CONNECTION SYSTEM HAVING SUCH A MONITORING DEVICE

BACKGROUND OF THE INVENTION

Field of the Invention

The present patent application claims priority of the German utility model application DE 20 2018 105 484.8, the content of which is included herein by reference.

The invention concerns a monitoring device for monitoring a temporary rail connection of two rail portions of a rail. Furthermore, the invention concerns a rail connection system for creating and monitoring a temporary rail connection of two rail portions of a rail.

DE 20 2017 103 074 U1 describes a rail connection system for creating and monitoring a temporary rail connection. After a rail breakage, a temporary connection of the successive rail portions is created by means of fishplates so that the track can continue to be used with restricted travel speed. For this, the fishplates are fixedly attached to both sides of the rail portions by clamps. To monitor the temporary rail connection, a safety device is provided which comprises two sensor plates. A first sensor plate is attached to a first side next to one of the fishplates by means of a clamp. The sensor plate comprises a first distance sensor which determines a distance between the first sensor plate and the adjacent fishplate. Correspondingly, the second sensor plate is attached to a second side next to the fishplate by means of a clamp. The second fishplate comprises a second distance sensor which determines a distance between the second sensor plate and the adjacent fishplate. If the measured distances change but their sum remains unchanged, it is known that the position of the fishplate has changed and the gap between the rail portions has remained constant. If however the sum of the measured distances changes, an enlargement of the gap between the rail portions is established.

SUMMARY OF THE INVENTION

The invention is based on the object of creating a simple monitoring device which allows reliable monitoring of a temporary rail connection of two rail portions of a rail.

This object may be achieved with a monitoring device for monitoring a temporary rail connection of two rail portions of a rail, with a first fixing element for fixing to a first rail portion and a second fixing element for fixing to a second rail portion, comprising a first distance sensor for measuring a first distance between the fixing elements and a second distance sensor for measuring a second distance between the first fixing element and a first clamping device of the temporary rail connection. The first fixing element is fixed to the first rail portion, whereas the second fixing element is fixed to the second rail portion. The fixing elements are in particular fixed to the rail foot of the respective rail portion. The fixing elements are arranged between a first clamping device and a second clamping device for at least one fishplate of the temporary rail connection. The fixing elements are in particular arranged on the same side of the rail. By means of the first distance sensor, the first distance between the fixing elements is measured. By means of the second distance sensor, the second distance between the first fixing element and the first clamping device for the at least one fishplate is measured. The first distance and the second distance are in particular measured repeatedly, each time in a common time window, preferably simultaneously and/or periodically. Using the first distance and the second distance, firstly an undesirable shift of the first fixing element and secondly an undesirable shift of the first clamping device are detected and distinguished. If both the first distance and also the second distance change, the first fixing element has shifted undesirably. If the second distance changes and the first distance remains the same, the first clamping device has shifted undesirably. From the first distance and the second distance, in particular in connection with a measured third distance between the second fixing element and a second clamping device of the temporary rail connection, it can also be established whether a gap between the rail portions has enlarged or whether a break point between the rail portions has widened. If the first distance has increased and the second distance and in particular also the third distance remain the same, the first fixing element and in particular also the second fixing element have not shifted, and the increase in the first distance is identified as an enlargement of the gap. By means of the monitoring device therefore, the temporary rail connection can be monitored in a simple and reliable fashion, and any changes occurring can be differentiated.

The first distance sensor is arranged for example on the first fixing element or on the second fixing element or on a connecting element connecting the fixing elements. The second distance sensor is in particular arranged on the first fixing element. Preferably, the second distance sensor is arranged at a side of the first fixing element which faces away from the second fixing element and/or towards the first clamping device.

A monitoring device comprising a third distance sensor for measuring a third distance between the second fixing element and a second clamping device of the temporary rail connection guarantees in simple fashion a reliable monitoring of the temporary rail connection. The third distance sensor is preferably arranged on the second fixing element. The third distance sensor is in particular arranged on a side of the second fixing element which faces away from the first fixing element and/or towards the second clamping device. The first distance and/or the second distance and the third distance are in particular measured repeatedly, in each case in a common time window, preferably simultaneously and/or periodically. Using the first distance and the third distance, an undesirable shift of the second fixing element and an undesirable shift of the second clamping device are detected and distinguished from each other. If both the first distance and also the third distance change, an undesirable shift of the second fixing element is detected. If however the third distance changes and the first distance remains the same, an undesirable shift of the second clamping device is established. If the first distance increases and the second distance and third distance remain the same, the first fixing element and the second fixing element have not shifted, and the increase in the first distance is reliably detected as an enlargement of the gap.

A monitoring device, in which the fixing elements are connected together by a connecting element, guarantees in simple fashion a reliable monitoring of the temporary rail connection. The connecting element connects the fixing elements to a component, allowing simpler handling and mounting or removal of the fixing elements.

A monitoring device, in which the connecting element is extendable in a rail longitudinal direction, guarantees in simple fashion a reliable monitoring of the temporary rail connection. Because the connecting element is extendable in the rail longitudinal direction, a reliable measurement of the first distance is guaranteed. If the gap between the rail portions enlarges, the connecting element also extends in the rail longitudinal direction so that measurement of the first distance is not adversely affected and/or influenced. Preferably, the connecting element is flexible or made from a flexible material, or made of several parts with connecting element parts which are movable relative to each other. Preferably, the connecting element is made of an elastomer material.

A monitoring device, in which the first distance sensor is arranged in the connecting element, guarantees in simple fashion a reliable monitoring of the temporary rail connection. Because the first distance sensor is arranged in the connecting element, the first distance sensor is protected from environmental influences, such as for example snow, mud or dust, and from damage. With a flexible or elastic design of the connecting element, for example if formed from an elastomer material, the first distance sensor is also protected from vibrations.

A monitoring device, in which the second distance sensor is integrated in the first fixing element and/or the third distance sensor is integrated in the second fixing element, guarantees in simple fashion a reliable monitoring of the temporary rail connection. By integrating the second distance sensor in the first fixing element and/or integrating the third distance sensor in the second fixing element, firstly a robust and compact structure of the monitoring device is achieved, and secondly the respective distance sensor is protected from environmental influences and damage. Preferably, the second distance sensor is arranged or integrated on an end face of the first fixing element which faces the first clamping device. Furthermore, preferably the third distance sensor is arranged or integrated on an end face of the second fixing element which faces the second clamping device.

A monitoring device, in which the first fixing element is connected to a first counter-fixing element and/or the second fixing element is connected to a second counter-fixing element, guarantees in simple fashion a reliable monitoring of the temporary rail connection. The fixing element and the respective counter-fixing element guarantee a secure and reliable fixing on both sides of the respective rail portion. The first fixing element and the first counter-fixing element, and/or the second fixing element and the second counter-fixing element, are connected together in particular by means of a screw connection. The fixing element and the associated counter-fixing element are connected together for example in the manner of a screw clamp. Preferably, the fixing element and the associated counter-fixing element are connected together such that they can be attached to a rail foot of the respective rail portion.

A monitoring device, in which the counter-fixing elements are connected together by a further connecting element, guarantees in simple fashion a reliable monitoring of the temporary rail connection. The further connecting element connects the counter-fixing elements to a component, allowing simpler handling and mounting or removal of the counter-fixing elements. Preferably, the first connecting element which connects the fixing elements together, and the second connecting element which connects the counter-fixing elements together, are designed to correspond to one another. In particular, the second connecting element is also formed so as to be extendable in a rail longitudinal direction.

A monitoring device comprising a fourth distance sensor for determining a movement of the rail relative to a ballast bed guarantees in simple fashion a reliable monitoring of the temporary rail connection. The fourth distance sensor serves for measuring a fourth distance which characterizes a movement of the rail or track relative to the ballast bed. The relative movement is also called breathing. The fourth distance sensor is configured such that it measures transversely, in particular perpendicularly, to the rail longitudinal direction and in the direction of a ballast bed. Preferably, the monitoring device comprises a reference element from which the fourth distance is measured. The reference element is in particular a reference measurement plate. The reference measurement plate is made for example from sheet steel. The reference element or reference measurement plate is arranged in the ballast bed on installation of the monitoring device. The relative movement between the fourth distance sensor and the reference element arranged in the ballast bed is measured and analyzed as a fourth distance. If the rails with the sleepers are pressed undesirably into the ballast bed on passage of a train, this is detected by means of the fourth distance sensor.

A monitoring device comprising an acceleration sensor and/or a temperature sensor guarantees in simple fashion a reliable monitoring of the temporary rail connection. By means of the acceleration sensor or vibration sensor, the gap between the rail portions and/or the load-bearing capacity of the ballast bed and/or a wheelset of a train travelling over the rails can be evaluated. A large gap between the rail portions causes high vibration values or shock values. The impact forces resulting from the gap between the rail portions on passage of a train causes the rails or sleepers to settle in the ballast bed. This leads to a relative movement between the rails, or breathing of the track. This relative movement can be detected by means of the acceleration sensor or vibration sensor. Furthermore, flat points on the wheels of the train travelling over the track cause vibrations which can be detected by means of the acceleration sensor or vibration sensor. The temperature sensor allows analysis of the measured distances depending on temperature or thermal length extension.

A monitoring device comprising a control unit for analysis of the measured distances guarantees in simple fashion a reliable monitoring of the temporary rail connection. The control unit in particular has a radio module for transmitting information/signals to a central control point. For this, the control unit in particular comprises a radio antenna. For energy supply, the control unit comprises an energy supply module which in particular comprises an accumulator. The control unit is connected to the distance sensors by means of a connecting cable for signal transmission.

The invention is furthermore based on the object of creating a simple rail connection system that allows a reliable creation and monitoring of a temporary rail connection of two rail portions of a rail.

This object may be achieved by a rail connection system for creating and monitoring a temporary rail connection of two rail portions of a rail, comprising at least one fishplate, a first clamping device for clamping the at least one fishplate to a first rail portion, a second clamping device for clamping the at least one fishplate to a second rail portion, and a monitoring device with a first fixing element for fixing to the first rail portion between the clamping devices, a second fixing element for fixing to the second rail portion between the clamping devices, a first distance sensor for measuring a first distance between the fixing elements, and a second distance sensor for measuring a second distance between the first fixing element and the first clamping device. The advantages of the rail connection system according to the invention correspond to the advantages already described for the monitoring device according to the invention. The monitoring device of the rail connection system may in particular also be refined with at least one of the above-mentioned features. According to the invention, the first distance sensor is arranged in the rail longitudinal direction between the fixing elements, which in turn are arranged between the clamping devices for clamping the at least one fishplate. Preferably, the rail connection system comprises at least two fishplates. The second distance sensor for measuring the second distance is arranged between the first fixing element and the first clamping device. The first fixing element is in turn arranged between the first clamping device and the second fixing element. Furthermore, the monitoring device in particular has a third distance sensor for measuring a third distance between the second fixing element and the second clamping device. The third distance sensor is arranged between the second fixing element and the second clamping device. The second fixing element is in turn arranged between the first fixing element and the second clamping device.

Further features, advantages and details of the invention arise from the following description of an exemplary embodiment.

DETAILED DESCRIPTION OF THE INVENTION

Figure 1:
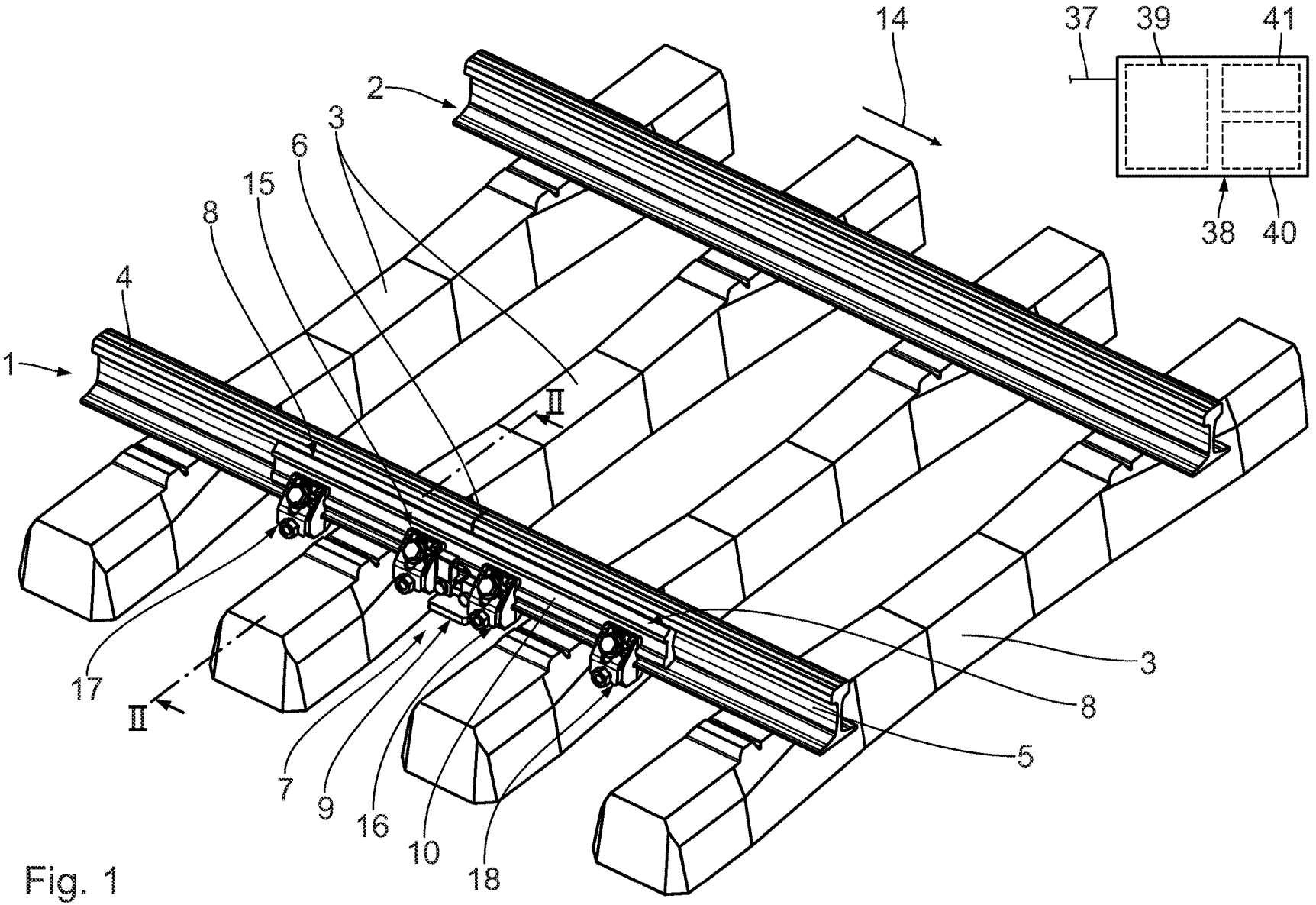
FIG. 1 a perspective view of a track with a broken rail which is temporarily connected by means of a rail connection system, FIG. 2 a section through the broken rail along cut line II-II from FIG. 1, FIG. 3 a side view of a monitoring device for monitoring the temporary rail connection, and FIG. 4 a top view of the monitoring device from FIG. 3.
Figure 2:
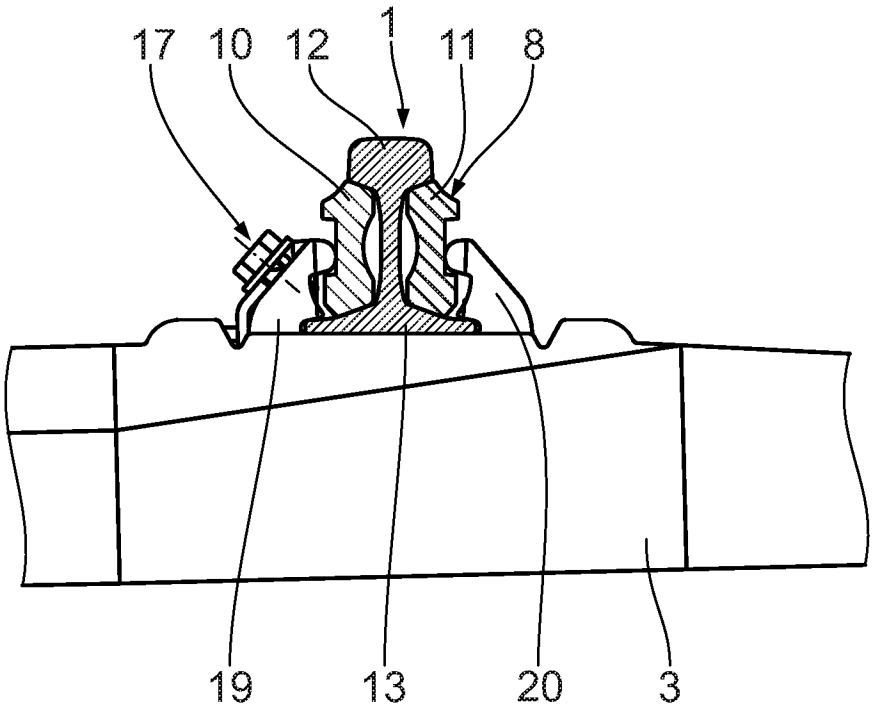
Figure 3:
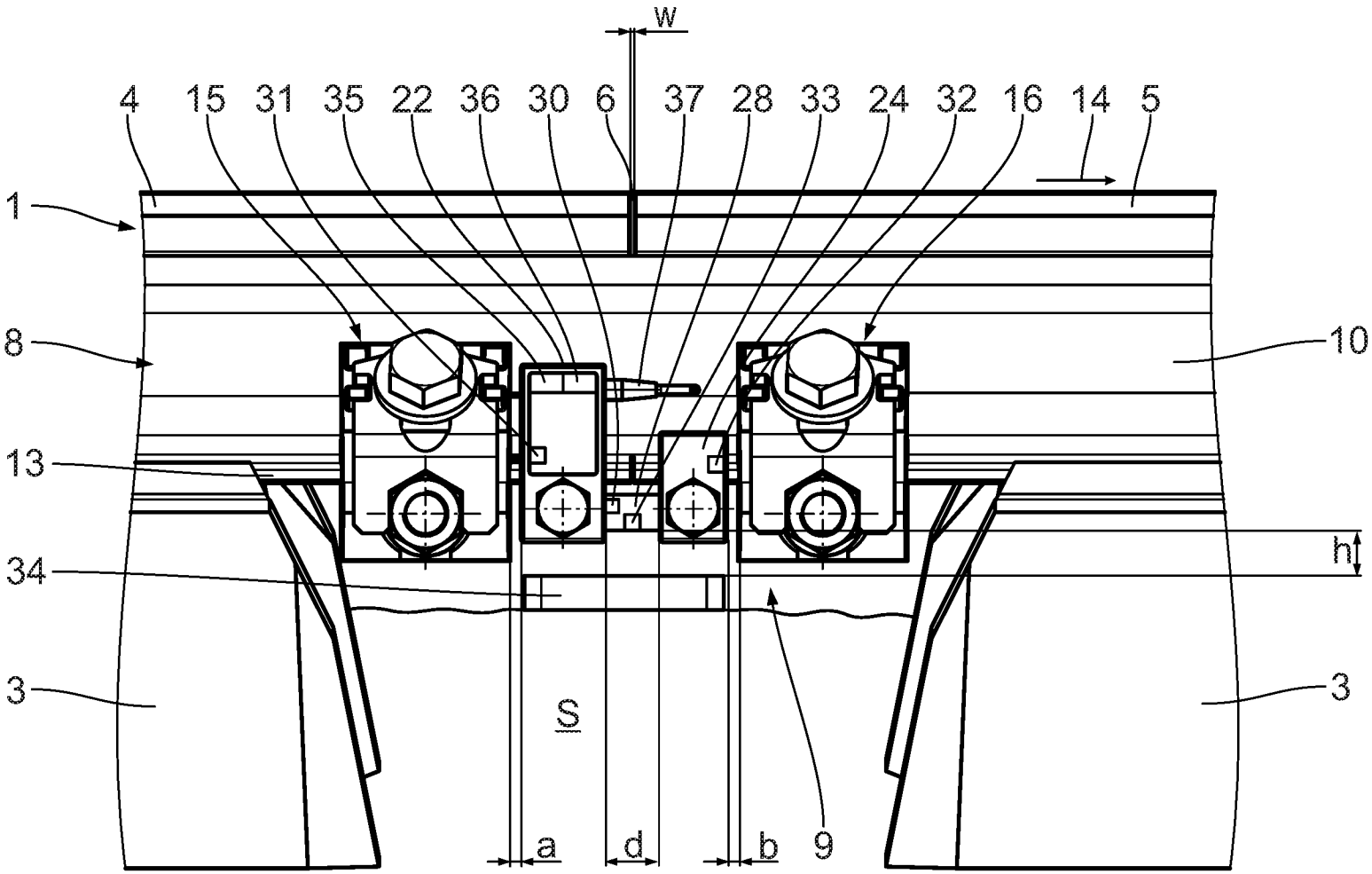
Figure 4:
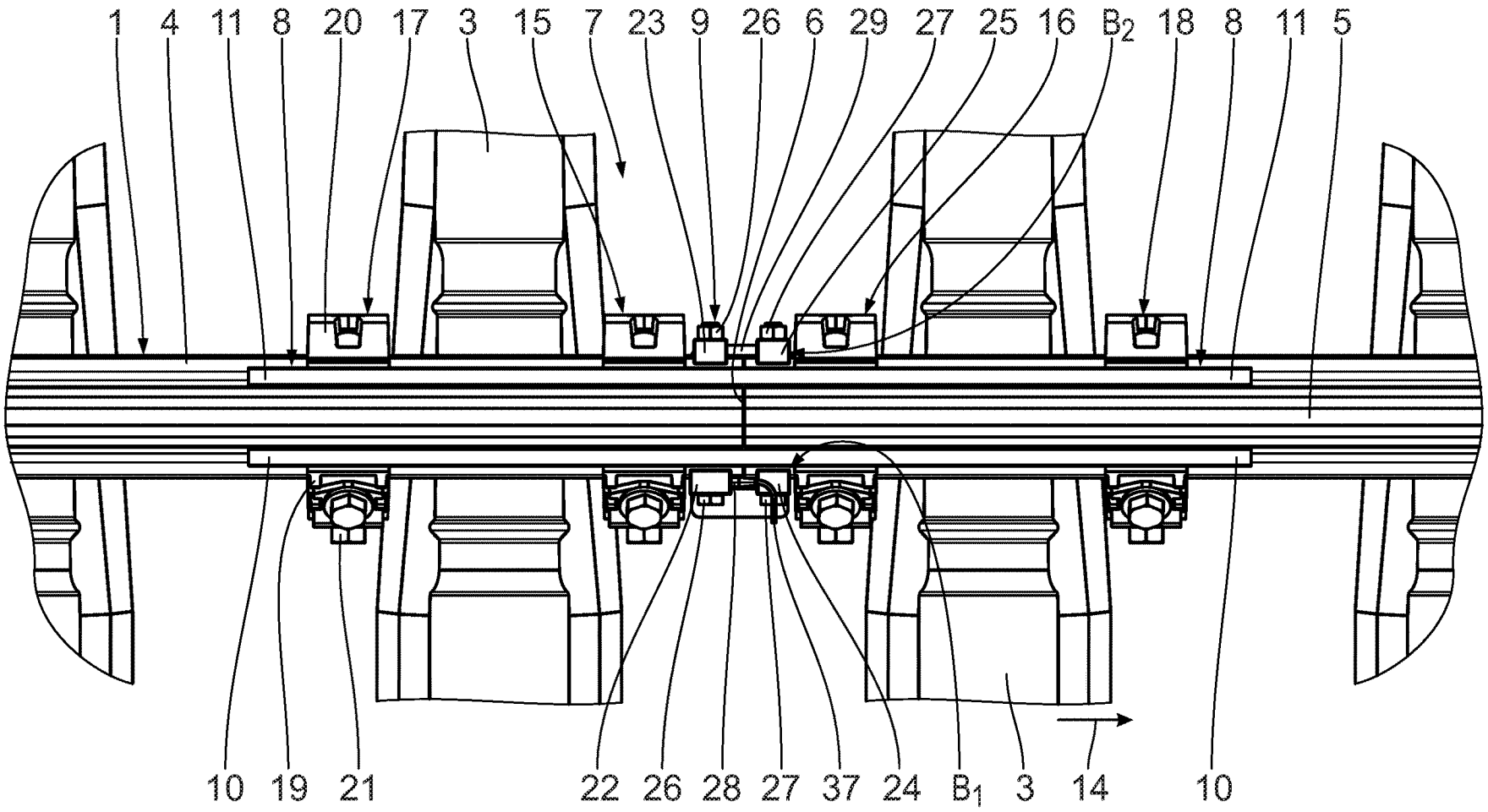

A track has two mutually parallel rails 1, 2 which are fixed to sleepers 3 in the conventional fashion (not shown). The sleepers 3 are arranged on a ballast bed S which serves to receive and support the sleepers 3. The rail 1 has a break point so that a gap 6 is formed between rail portions 4, 5.

A rail connection system 7 serves to create and monitor a temporary rail connection of the rail portions 4, 5. The rail connection system 7 comprises an emergency plate connector 8 for creating the temporary rail connection, and a monitoring device 9 for monitoring the temporary rail connection.

The emergency plate connector 8 has two fishplates 10, 11 which are arranged on both sides of the rail portions 4, 5 between a rail head 12 and a rail foot 13. The fishplates 10, 11 run in a rail longitudinal direction 14 and are connected to the first rail portion 4 by means of a first clamping device 15, and to the second rail portion 5 by means of a second clamping device 16. In addition, the fishplates 10, 11 are connected to the rail portion 4 by means of a third clamping device 17, which is arranged spaced from the first clamping device 15 in the rail longitudinal direction 14. Correspondingly, the fishplates 10, 11 are connected to the second rail portion 5 by means of a fourth clamping device 18, which is arranged spaced from the second clamping device 16 in the rail longitudinal direction 14.

Each of the clamping devices 15 to 18 has two clamping jaws 19, 20 which bear against the rail foot 13 and the respective fishplate 10, 11, and are clamped below the rail foot 13 by means of a threaded clamping bolt 21. The emergency plate connector 8 is depicted and described in detail in EP 1 697 592 B1, to which reference is made.

The monitoring device 9 comprises a first fixing element 22 with an associated first counter-fixing element 23, and a second fixing element 24 with an associated second counter-fixing element 25. The first fixing element 22 and the first counter-fixing element 23 are arranged on both sides of the rail portion 4 and attached to the rail foot 13 by means of a first screw connection 26. The first fixing element 22 and the first counter-fixing element 23 in this way form a first screw clamp. Correspondingly, the second fixing element 24 and the second counter-fixing element 25 are arranged on both sides of the rail portion 5 and attached to the rail foot 13 by means of a second screw connection 27. The second fixing element 24 and the second counter-fixing element 25 in this way form a screw clamp. The fixing elements 22, 24 and associated counter-fixing elements 23, 25 are thus arranged between the clamping devices 15, 16 in the rail longitudinal direction 14.

The fixing elements 22, 24 are connected together by means of a first connecting element 28 so as to form a first component $B_1$. Correspondingly, the counter-fixing elements 23, 25 are connected together by means of a second connecting element 29 so as to form a second component $B_2$. The connecting elements 28, 29 are extendable in the rail longitudinal direction 14. The connecting elements 28, 29 are made for example from an elastomer material.

To measure a first distance d between the fixing elements 22, 24, the monitoring device 9 has a first distance sensor 30. The first distance sensor 30 is integrated in the first connecting element 28 and in particular measures in the rail longitudinal direction 14, so that the measured first distance d changes depending on a width w of the gap 6.

The monitoring device 9 furthermore comprises a second distance sensor 31 which is integrated in the first fixing element 22 on a side facing the first clamping device 15, and a third distance sensor 32 which is integrated in the second fixing element 24 on a side facing the second clamping device 16. The second distance sensor 31 serves to measure a second distance a in the rail longitudinal direction 14 between the first fixing element 22 and the first clamping device 15. Similarly, the third distance sensor 32 serves to measure a third distance b in the rail longitudinal direction 14 between the second fixing element 24 and the second clamping device 16.

Furthermore, the monitoring device 9 comprises a fourth distance sensor 33 and an associated reference element 34. The fourth distance sensor 33 is arranged and oriented so that a fourth distance h is measured perpendicularly to the rail longitudinal direction 14 and in the direction of the ballast bed S. The fourth distance sensor 33 is arranged on one of the fixing elements 22, 24, one of the counter-fixing elements 23, 25, or one of the connecting elements 28, 29. As an example, the fourth distance sensor 33 is integrated in the first connecting element 28 on a side facing the ballast bed S. The reference element 34 is formed as a reference measurement plate, in particular made of sheet steel. The reference element 34 lies on the ballast bed S below the fourth distance sensor 33. By means of the fourth distance sensor 33 therefore, the fourth distance h is measured which characterizes the height difference between the fourth distance sensor 33 and the reference element 34.

The monitoring device 9 furthermore comprises an acceleration sensor 35 and a temperature sensor 36. The acceleration sensor 35 and the temperature sensor 36 are arranged on one of the fixing elements 22, 24, one of the counter-fixing elements 23, 25, and/or one of the connecting elements 28, 29. As an example, the acceleration sensor 35 and the temperature sensor 36 are integrated in the first fixing element 22.

The distance sensors 30 to 33, the acceleration sensor 35 and the temperature sensor 36 are electrically connected to a control unit 38 of the monitoring device 9 by means of a cable connection 37. The control unit 38 comprises an analysis module 39 for analysis of the measurement signals from the distance sensors 30 to 34, from the acceleration sensor 35 and from the temperature sensor 36; it also comprises an energy supply module 40 and a radio module 41. The energy supply module 40 serves to supply energy to the monitoring device 9, in particular the analysis module 39 and the radio module 41.

The function process of the rail connection system 7 and monitoring device 9 is as follows:

After a rail break of the rail 1, firstly the temporary rail connection of the rail portions 4 and 5 is created by means of the emergency plate connector 8. For this, the fishplates 10, 11 are attached in the usual fashion to the first rail portion 4 by means of the clamping devices 15, 17, and to the second rail portion 5 by means of the clamping devices 16, 18.

Then the monitoring device 9 is installed and commissioned. For this, components $B_1$ and $B_2$ are attached between the clamping devices 15, 16 by means of the screw connections 26, 27. The first fixing element 22 and the associated first counter-fixing element 23 are attached to the first rail portion 4, whereas the second fixing element 24 and second counter-fixing element 25 are attached to the second rail portion 5. By means of the screw connections 26, 27, the components $B_1$ and $B_2$ are applied or clamped to the respective rail foot 13 of the rail portions 4, 5. The reference element 34 is arranged in the ballast bed S below the fourth distance sensor 33. The distance sensors 30 to 33, the acceleration sensor 35 and the temperature sensor 36 are connected electrically conductively and for signal transmission to the control unit 38 by means of the cable connection 37.

Reference values for the first to fourth distances, designated individually as $d_0$, $a_0$, $b_0$ and $h_0$, are then determined.

The monitoring device 9 repeatedly, in particular periodically, and in a common time window, in particular simultaneously, determines measurement values for the distances d, a, b and h, and for the acceleration of the rail 1 and for the temperature.

By means of the control unit 38, using the measurement values for the distances d, a, and b, the following problem scenarios are detected and distinguished:

On a widening of the gap 6 and an increasing width w, in comparison with reference value $d_0$, a larger first distance d is determined. If distances a and b remain the same in comparison with reference values $a_0$ and $b_0$, the control unit 38 detects the widening of the gap 6.

An undesirable shift of the first fixing element 22 is detected via the second distance a, if this changes in comparison with the reference value $a_0$ and at the same time the first distance d changes in comparison with the reference value $d_0$.

Accordingly, an undesirable shift of the second fixing element 24 is detected via the third distance b, if this changes in comparison with the reference value $b_0$ and at the same time the first distance d changes in comparison with the reference value $d_0$.

An undesirable shift of the first clamping device 15 is detected via the second distance a, if this changes in comparison with the reference value $a_0$ and at the same time the first distance d remains the same in comparison with the reference value $d_0$.

Accordingly, an undesirable shift of the second clamping device 16 is detected via the third distance b, if this changes in comparison with the reference value $b_0$ and at the same time the first distance d remains the same in comparison with reference value $d_0$.

The respective problem scenario is detected by means of the analysis module 39 and a corresponding analysis signal is transmitted to the central control point by means of the radio module 41.

If a train travels over the temporary rail connection, the rails 1, 2 with sleepers 3 are pressed into the ballast bed S, whereas the height of the ballast bed S between the sleepers 3 remains unchanged. This relative movement is described as breathing of the track. The breathing of the track or the relative movement between the rail 1 and the ballast bed S is detected by comparing the measurement values for the fourth distance h with the reference value $h_0$. If an undesirable relative movement is established, the radio module 41 transmits a corresponding analysis signal to the central control point. Thus the breathing of the track is also detected as a problem scenario.

By means of the measured temperature, the measured distances d, a, b and/or h are evaluated and where applicable corrected. The measured temperature in particular allows correction of the thermal length extension in the rail longitudinal direction 14.

The acceleration or accelerations measured by means of the acceleration sensor 35 allow firstly an evaluation of the gap when a train passes over the temporary rail connection. High measurement values are an indication of a damaged temporary rail connection. Secondly, the measurement values allow detection of a flat point on a wheel of the train passing over the temporary rail connection, since such flat points generate characteristic and identifiable vibrations. In addition, the breathing of the rail 1 can be determined by means of the measurement values as an alternative or in addition to the fourth distance sensor 33.

The rail connection system 7 and the monitoring device 9 thus, in simple fashion, allow reliable creation and monitoring of the temporary rail connection. The monitoring device 9 allows detection and differentiation of a multiplicity of different problem scenarios, and transmits corresponding analysis signals to a central control point.

The invention claimed is:

1. A monitoring device for monitoring a temporary rail connection of two rail portions of a rail, the monitoring device comprising:

a first fixing element to be fixed to a first rail portion;

a second fixing element to be fixed to a second rail portion;

a first distance sensor for measuring a first distance between said first and second fixing elements;

a second distance sensor for measuring a second distance between said first fixing element and a first clamping device of the temporary rail connection; and a connecting element interconnecting said first and second fixing elements;

wherein said first distance sensor is disposed in said connecting element.

2. The monitoring device according to claim 1, which further comprises a third distance sensor for measuring a third distance between said second fixing element and a second clamping device of the temporary rail connection.

3. The monitoring device according to claim 1, wherein said connecting element is extendable in a rail longitudinal direction.

4. The monitoring device according to claim 2, which further comprises an integration of at least one of:

said second distance sensor in said first fixing element, or said third distance sensor in said second fixing element.

5. The monitoring device according to claim 1, which further comprises:

a first counter-fixing element;

a second counter-fixing element; and a connection of at least one of:

said first fixing element to said first counter-fixing element; or said second fixing element to said second counter-fixing element.

6. The monitoring device according to claim 5, which further comprises a further connecting element interconnecting said first and second counter-fixing elements.

7. The monitoring device according to claim 1, which further comprises a fourth distance sensor for determining a movement of the rail relative to a ballast bed.

8. The monitoring device according to claim 1, which further comprises at least one of an acceleration sensor or a temperature sensor.

9. The monitoring device according to claim 1, which further comprises a control unit configured for analyzing the first distance measured by the first distance sensor and configured for analyzing the second distance measured by the second distance sensor.

10. A rail connection system for creating and monitoring a temporary rail connection of two rail portions of a rail, the rail connection system comprising:

at least one fishplate;

a first clamping device for clamping said at least one fishplate to a first rail portion;

a second clamping device for clamping said at least one fishplate to a second rail portion; and a monitoring device including:

a first fixing element to be fixed to the first rail portion between said first and second clamping devices;

a second fixing element to be fixed to the second rail portion between said first and second clamping devices;

a first distance sensor for measuring a first distance between said first and second fixing elements;

a second distance sensor for measuring a second distance between said first fixing element and said first clamping device; and a connecting element interconnecting said first and second fixing elements;

wherein said first distance sensor is disposed in said connecting element.

11. A monitoring device for monitoring a temporary rail connection of two rail portions of a rail, the monitoring device comprising:

a first fixing element to be fixed to a first rail portion;

a second fixing element to be fixed to a second rail portion;

a first distance sensor for measuring a first distance between said first and second fixing elements; and a second distance sensor for measuring a second distance between said first fixing element and a first clamping device of the temporary rail connection;

said first distance sensor configured to measure said first distance in a rail longitudinal direction.

* * * * *